US007362999B2

(12) United States Patent
Petschke et al.

(10) Patent No.: US 7,362,999 B2
(45) Date of Patent: Apr. 22, 2008

(54) METHOD AND SYSTEM FOR CUSTOMIZED MUSIC DELIVERY

(75) Inventors: Julianne Petschke, Shelby Township, MI (US); Patty Valerio Kogowski, Macomb, MI (US)

(73) Assignee: General Motors Corporation, Detroit, MI (US)

( * ) Notice: Subject to any disclaimer, the term of this patent is extended or adjusted under 35 U.S.C. 154(b) by 636 days.

(21) Appl. No.: 10/924,012

(22) Filed: Aug. 23, 2004

(65) Prior Publication Data

US 2006/0040609 A1 Feb. 23, 2006

(51) Int. Cl.
*H04H 1/00* (2006.01)

(52) U.S. Cl. ..... 455/3.02; 455/3.06; 455/12.1; 455/427; 455/556.1; 455/525.9; 455/557; 725/131; 725/63; 725/110

(58) Field of Classification Search ..... 455/3.01, 455/3.02, 3.04, 3.06, 184.1, 185.1, 186.1, 455/187.1, 180.1, 158.4, 456.1, 345, 556.1, 455/344, 575.9, 414.3, 414.4, 557, 90.1–90.3, 455/569.1, 12.1, 426.1, 427; 725/173, 131, 725/63, 110, 134

See application file for complete search history.

(56) References Cited

U.S. PATENT DOCUMENTS

| | | | | |
|---|---|---|---|---|
| 6,961,536 | B2 * | 11/2005 | Himmel et al. | 455/3.01 |
| 7,200,357 | B2 * | 4/2007 | Janik et al. | 455/3.02 |
| 2002/0002039 | A1 * | 1/2002 | Qureshey et al. | 455/344 |
| 2002/0049717 | A1 * | 4/2002 | Routtenberg et al. | 707/1 |
| 2002/0065037 | A1 * | 5/2002 | Messina et al. | 455/12.1 |
| 2003/0014767 | A1 * | 1/2003 | Stumphauzer, II | 725/131 |
| 2003/0131252 | A1 * | 7/2003 | Barton | 713/193 |
| 2004/0204069 | A1 * | 10/2004 | Cui et al. | 455/557 |
| 2005/0203991 | A1 * | 9/2005 | Kawamura et al. | 709/203 |
| 2006/0010167 | A1 * | 1/2006 | Grace et al. | 707/104.1 |
| 2006/0088292 | A1 * | 4/2006 | Guillen et al. | 286/96 |
| 2006/0134959 | A1 * | 6/2006 | Ellenbogen | 439/297 |

* cited by examiner

*Primary Examiner*—Sujatha Sharma

(57) ABSTRACT

A system and method for customized music delivery to a vehicle including determining a playlist 200, storing the playlist on a server 202, selecting content corresponding to the playlist 204, transmitting the content to the vehicle by satellite 206, and storing the content in a telematics unit 208.

14 Claims, 2 Drawing Sheets

METHOD AND SYSTEM FOR CUSTOMIZED MUSIC DELIVERY

FIELD OF THE INVENTION

The invention relates to vehicles, and more particularly to methods and systems for customized music delivery to a mobile vehicle.

BACKGROUND OF THE INVENTION

Portable music players, such as MP3 and CD players, have developed to the extent that consumers increasingly expect to be able to listen to the particular music they enjoy wherever they are. Yet, it is difficult for the consumer to have customizable music in their car or other vehicle.

One approach has been to adapt portable music players for vehicular use, either as external plug-in devices or built-in devices. External plug-in devices use a portable music player wired into the vehicular sound system. This requires additional wiring for a jack and may even require modification of the vehicle's wiring system. The amateur electrician can inflict damage on the wiring during the modification and incur expensive repairs. Operation of the devices can distract the driver from the road. Built-in devices, such as CD players, are limited by the medium played.

The media available are a major limitation to customizable music. Music is stored in one of a number of audio formats on a CD, a hard drive, or solid-state memory. The consumer typically selects an audio format compatible with their device and prepares or "burns" the music onto the desired media. The burning process is complicated, time consuming, and requires a computer. The consumer is limited to songs within their personal library and by the constraints of copyright law. The songs can be played in order or randomly, but cannot be automatically played at a desired frequency. Another problem is the quality of the music: audio formats normally compress the music to increase the number of songs that can be stored in a given amount of memory, reducing the audio quality on playback.

One solution to improve music quality has been satellite radio, which provides a high-quality, digital music signal from a satellite to a vehicle. Although the music quality is excellent, the programming is not customizable to the particular user. The programming is selected by the radio station. At best, the radio station plays a particular type of music or music selections selected by the listeners.

It would be desirable to have a method and system for customized music delivery to a mobile vehicle that overcomes the above disadvantages.

SUMMARY OF THE INVENTION

The present invention provides a method for customized music delivery to a vehicle including determining a playlist, storing the playlist on a server, selecting content corresponding to the playlist, transmitting the content to the vehicle by satellite, and storing the content in a telematics unit.

Another aspect of the invention provides a system for delivering customized music to a vehicle, including means for determining a playlist, means for storing the playlist on a server, means for selecting content corresponding to the playlist, means for transmitting the content to the vehicle by satellite, and means for storing the content in a telematics unit.

Yet another aspect of the invention provides a computer readable medium for delivering customized music to a vehicle, including computer readable code for determining a playlist, computer readable code for storing the playlist on a server, computer readable code for selecting content corresponding to the playlist, computer readable code for transmitting the content to the vehicle by satellite, and computer readable code for storing the content in a telematics unit.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENT

Figure 1:
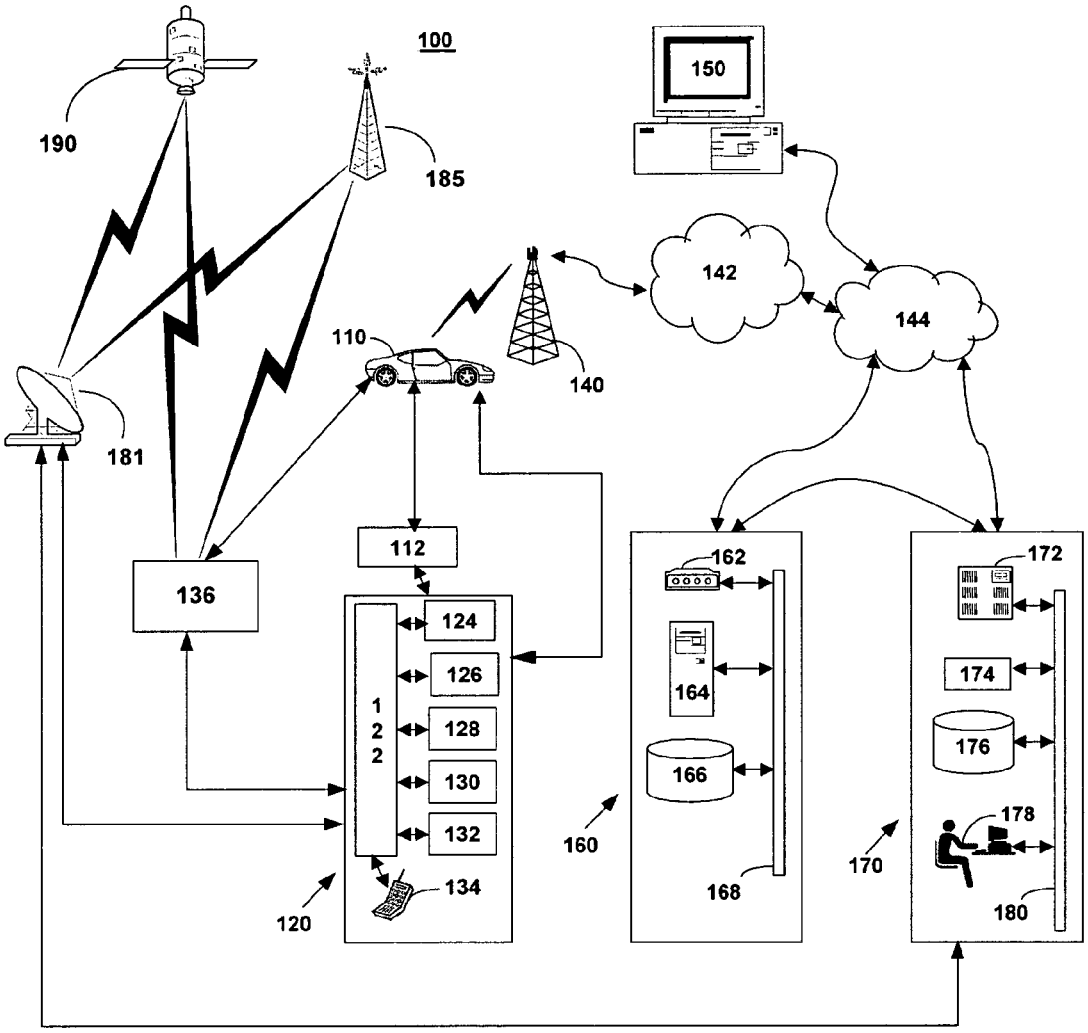
FIG.1 is an illustrative operating environment for customized music delivery in accordance with one embodiment of the present invention.

FIG.1 is an illustrative operating environment for customized music delivery in accordance with one embodiment of the present invention. FIG. 1 shows a mobile vehicle communication system 100. System 100 includes at least one mobile vehicle 110 (vehicle) including vehicle communication network 112 and telematics device 120; a satellite radio receiver system 136; one or more wireless carrier systems 140; one or more communication networks 142; one or more land networks 144; one or more client, personal, or user computers 150; one or more web-hosting portals 160; one or more call centers 170; one or more satellite radio service uplink facilities 181; one or more terrestrial radio transmitters 185; and one or more satellite radio service geostationary satellites 190. In one embodiment, mobile vehicle 110 is implemented as a vehicle equipped with suitable hardware and software for transmitting and receiving voice and data communications. The telematics device 120 is also called a vehicle communications unit (VCU) or a telematics unit.

In one embodiment, the telematics device 120 includes a processor 122 connected to a wireless modem 124, a global positioning system (GPS) unit 126, an in-vehicle memory 128 such as, for example, a non-volatile flash memory or a hard drive, a microphone 130, one or more speakers 132, and an embedded or in-vehicle mobile phone 134. In one embodiment, processor 122 is a microcontroller, controller, host processor, or vehicle communications processor. In an example, processor 122 is implemented as an application specific integrated circuit (ASIC). GPS unit 126 provides longitude and latitude coordinates of the vehicle, as well as a time and date stamp. In one embodiment, at least part of the in-vehicle memory 128 is removable for use outside the vehicle 110. In-vehicle mobile telephone system 134 is a cellular-type phone such as, for example, an analog, digital, dual-mode, dual-band, multi-mode, or multi-band cellular phone. In another example, the mobile telephone system is an analog mobile telephone system operating over a prescribed band nominally at 800 MHz. In yet another example, the mobile telephone system is a digital mobile telephone system operating over a prescribed band nominally at 800 MHz, 900 MHz, 1900 MHz, or any suitable band capable of carrying digital cellular communications. The components of the telematics device 120 can be distributed throughout the vehicle and need not be mounted within a single enclosure.

Processor 122 executes various computer programs and communication control and protocol algorithms that affect communication, programming, and operational modes of electronic and mechanical systems within vehicle 110. In one embodiment, processor 122 is an embedded system controller. In another embodiment, processor 122 controls communications between telematics device 120, wireless carrier system 140, call center 170, terrestrial radio transmitter 185, and satellite radio geostationary satellite 190. In yet another embodiment, processor 122 controls communications between the wireless modem 124 and nodes of a mobile ad hoc network. In still another embodiment, processor 122 provides processing, analysis, and control functions for determining engine emission performance for vehicle 110. Processor 122 is configured to generate and receive digital signals transmitted between telematics device 120 and a vehicle communication network 112 that is connected to various electronic modules in the vehicle 110. In one embodiment, the digital signals activate a programming mode and operation modes, as well as provide for data transfers. In another embodiment, a utility program facilitates the transfer of emission data, emission analysis data, instructions, triggers, and data requests between vehicle 110 and a call center 170.

Mobile vehicle 110, via a vehicle communication network 112, sends signals to various units of equipment and systems within vehicle 110 to perform various functions such as monitoring the operational state of vehicle systems, collecting and storing data from the vehicle systems, providing instructions, data and programs to various vehicle systems, and calling from telematics device 120. In facilitating interactions among the various communication and electronic modules, vehicle communication network 112 utilizes interfaces such as controller-area network (CAN), International Organization for Standardization (ISO) Standard 9141, ISO Standard 11898 for high-speed applications, ISO Standard 11519 for lower speed applications, and Society of Automotive Engineers (SAE) standard J1850 for higher and lower speed applications. In one embodiment, vehicle communication network 112 is a direct connection between connected devices.

Vehicle 110, via telematics device 120, sends and receives radio transmissions from wireless carrier system 140. Wireless carrier system 140 is implemented as any suitable system for transmitting a signal from mobile vehicle 110 to communication network 142. Wireless carrier system 140 incorporates any type of telecommunications in which electromagnetic waves carry signal over part of or the entire communication path. In one embodiment, wireless carrier system 140 transmits analog audio and/or video signals. In an example, wireless carrier system 140 transmits analog audio and/or video signals such as those sent from AM and FM radio stations and transmitters, or digital audio signals in the S band (approved for use in the U.S.) and L band (used in Europe and Canada). In one embodiment, wireless carrier system 140 is a satellite broadcast system broadcasting over a spectrum in the S band (2.3 GHz) that has been allocated by the U.S. Federal Communications Commission (FCC) for nationwide broadcasting of satellite-based Digital Audio Radio Service (DARS).

Communication network 142 includes services from one or more mobile telephone switching offices and wireless networks. Communication network 142 connects wireless carrier system 140 to land network 144. Communication network 142 is implemented as any suitable system or collection of systems for connecting wireless carrier system 140 to mobile vehicle 110 and land network 144. In one example, wireless carrier system 140 includes a short message service, modeled after established protocols such as IS-637 SMS standards, IS-136 air interface standards for SMS, and GSM 03.40 and 09.02 standards. Similar to paging, an SMS communication could be broadcast to a number of regional recipients. In another example, the carrier system 140 uses services in accordance with other standards such as, for example, IEEE 802.11 compliant wireless systems and Bluetooth compliant wireless systems.

Land network 144 is a public-switched telephone network (PSTN). In one embodiment, land network 144 is implemented as an Internet protocol (IP) network. In other embodiments, land network 144 is implemented as a wired network, an optical network, a fiber network, another wireless network, a virtual private network (VPN), or any combination thereof. Land network 144 is connected to one or more landline telephones. Land network 144 connects communication network 142 to computer 150, web-hosting portal 160, and call center 170. Communication network 142 and land network 144 connect wireless carrier system 140 to web-hosting portal 160 and call center 170.

Client, personal, or user computer 150 includes a computer usable medium to execute Internet-browser and Internet-access computer programs for sending and receiving data over land network 144 and, optionally, wired or wireless communication networks 142 to web-hosting portal 160 and vehicle 110. Computer 150 sends data to web-hosting portal 160 through a web-page interface using communication standards such as hypertext transport protocol (HTTP) and transport-control protocol Internet protocol (TCP/IP). In one embodiment, the data includes directives to change certain programming and operational modes of electronic and mechanical systems within vehicle 110. In another embodiment, the data includes requests for certain data, such as vehicle system performance information. In operation, a user, such as, for example, a vehicle designer or manufacturing engineer, utilizes computer 150 to exchange information with mobile vehicle 110 that is cached or stored in web-hosting portal 160. In an embodiment, vehicle system performance information from client-side software is transmitted to server-side software of web-hosting portal 160. In one embodiment, vehicle system performance information is stored at web-hosting portal 160. In another embodiment, computer 150 includes a database (not shown) for storing received vehicle system performance data. In yet another embodiment, a private Local Area Network (LAN) is implemented for client computer 150 and web-hosting portal 160, such that web-hosting portal is operated as a Virtual Private Network (VPN).

Web-hosting portal 160 includes one or more data modems 162, one or more web servers 164, one or more databases 166, and a network 168. Web-hosting portal 160 is connected directly by wire to call center 170, or connected by phone lines to land network 144, which is connected to call center 170. Web-hosting portal 160 is connected to land network 144 by one or more data modems 162. Land network 144 transmits digital data to and from modem 162, data that is subsequently transferred to web server 164. In one implementation, modem 162 resides inside web server 164. Land network 144 transmits data communications between web-hosting portal 160 and call center 170.

Web server 164 receives various data, requests, or instructions from computer 150 via land network 144. In alternative embodiments, computer 150 includes a wireless modem to send data to web-hosting portal 160 through a wireless communication network 142 and a land network 144. Data is received by modem 162 and sent to one or more web servers 164. In one embodiment, web server 164 is implemented as any suitable hardware and software capable of providing web services to transmit and receive data from computer 150 to telematics device 120 in vehicle 110. Web server 164 sends to or receives data transmissions from one or more databases 166 via network 168. In an embodiment, web server 164 includes computer applications and files for managing emission performance data.

In one embodiment, one or more web servers 164 are networked via network 168 to distribute vehicle engine emission performance data among its network components such as database 166. In an example, database 166 is a part of or a separate computer from web server 164. In one embodiment, web-server 164 sends data transmissions including vehicle system performance information to call center 170 via modem 162, and through land network 144.

Call center 170 is a location where many calls are received and serviced at the same time, or where many calls are sent at the same time. In one embodiment, the call center is a telematics call center, facilitating communications to and from telematics device 120 in vehicle 110. In an example, the call center is a voice call center, providing verbal communications between an advisor in the call center and a subscriber in a mobile vehicle. In another example, the call center contains each of these functions. In other embodiments, call center 170 and web-hosting portal 160 are located in the same or different facilities.

Call center 170 contains one or more voice and data switches 172, one or more communication services managers 174, one or more communication services databases 176, one or more communication services advisors 178, and one or more networks 180.

Switch 172 of call center 170 connects to land network 144. Switch 172 transmits voice or data transmissions from call center 170, and receives voice or data transmissions from telematics device 120 in mobile vehicle 110 through wireless carrier system 140 and/or wireless modem 124, communication network 142, and land network 144. Switch 172 receives data transmissions from and sends data transmissions to one or more web-hosting portals 160. Switch 172 receives data transmissions from or sends data transmissions to one or more communication services managers 174 via one or more networks 180.

Communication services manager 174 is any suitable hardware and software capable of providing communication services to telematics device 120 in mobile vehicle 110. Communication services manager 174 sends to or receives data transmissions from one or more communication services databases 176 via network 180. Communication services manager 174 sends to or receives data transmissions from one or more communication services advisors 178 via network 180. Communication services database 176 sends to or receives data transmissions from communication services advisor 178 via network 180. Communication services advisor 178 receives from or sends voice or data transmissions to switch 172.

Communication services manager 174 facilitates one or more services, such as, but not limited to, enrollment services, navigation assistance, directory assistance, roadside assistance, business or residential assistance, information services assistance, emergency assistance, communications assistance, and telematics retrieval of vehicle system performance information. Communication services manager 174 transmits and receives operational status, instructions, and other types of vehicle data to telematics device 120 in mobile vehicle 110 through wireless carrier system 140, communication network 142, land network 144, wireless modem 124, voice and data switch 172, and network 180. Communication services manager 174 stores or retrieves vehicle system performance information from communication services database 176. Communication services manager 174 provides requested information to communication services advisor 178.

In one embodiment, communication services advisor 178 is a real advisor. In another embodiment, communication services advisor 178 is implemented as a virtual advisor. In an example, a real advisor is a human being at a service provider service center in verbal communication with a service subscriber in mobile vehicle 110 via telematics device 120. In another example, a virtual advisor is implemented as a synthesized voice interface responding to requests from telematics device 120 in mobile vehicle 110.

Communication services advisor 178 provides services to telematics device 120 in mobile vehicle 110. Services provided by communication services advisor 178 include enrollment services, navigation assistance, real-time traffic advisories, directory assistance, roadside assistance, business or residential assistance, information services assistance, emergency assistance, and communications assistance. Communication services advisor 178 communicates with telematics device 120 in mobile vehicle 110 through wireless carrier system 140, communication network 142, and land network 144 using voice transmissions, or through communication services manager 174 and switch 172 using data transmissions. Switch 172 selects between voice transmissions and data transmissions.

Mobile vehicle 110 initiates service requests to call center 170 by sending a voice or digital-signal command to telematics device 120, which, in turn, sends an instructional signal or a voice call through wireless modem 124, wireless carrier system 140, communication network 142, and land network 144 to call center 170. In one embodiment, one or more triggers stored in the telematics device 120 cause the vehicle to initiate a service request. The trigger is, for example, a number of ignition cycles, a specific time and date, an expired time, a number of kilometers, an absolute Global Positioning System (GPS) timestamp, a request for vehicle emission performance data, and the like.

A Satellite Based Digital Radio Service System (SDARS) provides radio programming from geostationary satellite 190 to vehicle 110. The SDARS system includes a satellite radio uplink facility 181 in communication with the telematics service call center 170 that sends radio signals to the geostationary satellite 190. The geostationary satellite 190 transmits radio signals to satellite radio receiver system 136 in vehicle 110. In one embodiment, the terrestrial radio transmitter 185 transmits radio signals to satellite radio receiver system 136 in vehicle 110. The terrestrial radio transmitter 185 can carry out the same functions as the geostationary satellite 190 when the vehicle 110 is within range of the terrestrial radio transmitter 185. Those skilled in the art will appreciate that the SDARS can be used to transmit any digital information, such as video programming.

In one embodiment, the terrestrial radio transmitter 185 and geostationary satellite 190 broadcast over a spectrum in the S band (2.3 GHz) that has been allocated by the U.S. Federal Communications Commission (FCC) for nationwide broadcasting of Satellite Based Digital Radio Service (SDARS). An exemplary broadcast has a 120 kilobyte per second portion of the bandwidth designated for command signals from the telematics service call center 170.

The SDARS system broadcasts music and entertainment, traffic information, road construction information, advertisements, news, local event information, and the like. The SDARS system can also transmit information about the program being broadcast. In one embodiment, the information includes the names of the program and program artist. For example, if the program is a song, the information can include the name of the song and the artist.

In one embodiment, the satellite radio receiver system 136 is separate from the telematics unit 120. In an alternative embodiment, the satellite radio receiver system 136 is electronically connected to the telematics unit 120 with a cable or over the vehicle communication bus. In another embodiment, the satellite radio receiver system 136 is embedded within the telematics unit 120. In one embodiment, the satellite radio receiver system 136 provides channel and signal information to the telematics unit 120. The telematics unit 120 monitors, filters and sends signals that are received from satellite broadcast, radio broadcasts or other wireless communication systems to output devices, such as the speaker 132 and visual display devices. In another embodiment, the signals from the satellite radio receiver system 136 are sent directly to independent output devices, such as speakers and visual display devices, without the intervening telematics unit 120.

Figure 2:
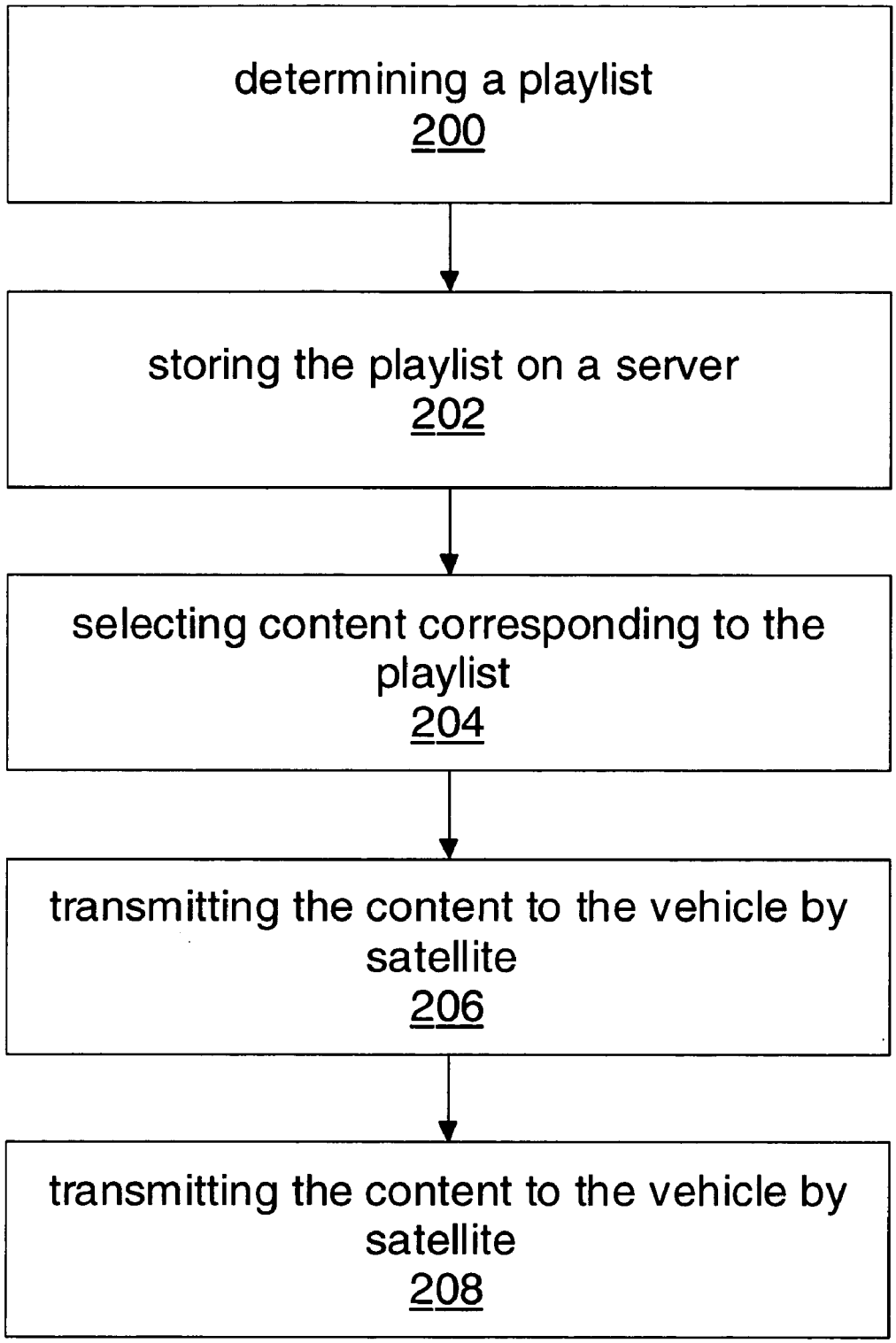
FIG. 2 is a flow diagram of a method for customized music delivery in accordance with one embodiment of the present invention.

FIG. 2 is a flow diagram of a method for customized music delivery in accordance with one embodiment of the present invention. The method includes determining a playlist 200, storing the playlist on a server 202, selecting content corresponding to the playlist 204, transmitting the content to the vehicle by satellite 206, and storing the content in a telematics unit 208. The method operates within an environment and using a system such as the exemplary system of FIG. 1. The method is embodied in a computer usable medium for customized music delivery including computer readable code for executing the method described by FIG. 2.

Determining a playlist 200 includes the user specifying the playlist of desired content. The playlist determines what content is transmitted by satellite for storage in the vehicle. The content is any content which can be played on an audio or video player, such as songs, music, spoken word, news, comedy, video clips, television programs, movies, maps, graphical information, playable data, computer programs, or any other digitally encoded playable information. The content is typically divided into segments, such as songs or episodes. In one embodiment, the playlist is a list of songs. The user can select the playlist by individual segments or can choose predetermined groups of segments, such as selecting a "Top Ten" list or segments selected by a similar demographic group The playlist can be determined at various locations. In one embodiment, the user selects the content on a computer connected to the land network at a general website or at their personal telematics website. Selection from a web-enabled computer allows the user to select from a large amount of content. In an alternate embodiment, the user selects the content at the vehicle, such as selecting the content at the satellite radio receiver system or the telematics unit. Selection at the vehicle allows the user to select specific content for the playlist as content broadcast from the satellite plays in the vehicle.

Storing the playlist on a server 202 includes storing the playlist on a server in communication with the satellite uplink facility. The playlist can be a completely new playlist or can be a modified playlist, which adds to, modifies, or deletes content of a previously stored playlist. In one embodiment, the playlist is stored on a communication services database in the call center. The playlist can also be stored in additional locations, such as on the user's computer or in the vehicle.

Selecting content corresponding to the playlist 204 includes selecting content listed on the playlist for upload. In one embodiment, the content listed on the playlist is selected from a server at the call center and provided directly to the satellite radio uplink facility. In an alternate embodiment, the content listed on the playlist is selected from an intermediate server and provided to the satellite radio uplink facility. The content can be completely new content or can be modified content, which adds to, modifies, or deletes content of a previously stored playlist.

Transmitting the content to the vehicle by satellite 206 includes transmitting the content from a satellite radio uplink facility to a geostationary satellite and from the geostationary satellite to the vehicle. In one embodiment, the transmission is triggered by the call center detecting a change in the playlist. In one embodiment, the content is compressed for faster transmission.

Storing the content in a telematics unit 206 includes storing the content in memory of the telematics unit, such as in non-volatile flash memory or on a hard drive, for example. In one embodiment, the content is compressed in one of the generally used compression formats, such as MP3, to conserve memory space. In an alternate embodiment, the content is uncompressed to preserve content playback quality. The content stored in the telematics unit can be played through the satellite radio receiver system, the telematics unit, or an autonomous in-vehicle playback unit.

Additional information can be determined for the content, stored on the server, transmitted to the vehicle by satellite, and/or stored in the telematics unit in a similar manner to the processing of content. Examples of additional information include associated content information, play control parameters, or the like.

Associated content information includes information about the content, such as song running time, artist name, album name, artist label, music genre, or the like. The associated content information can be determined automatically from a database on a server when determining a playlist 200 or selecting content corresponding to the playlist 204. In one embodiment, the associated content information is determined manually by the user or another person, rather than automatically. The associated content information can be stored and transmitted with the content. The associated content information can be displayed at the vehicle when the content is played.

Play control parameters are associated with the content to control playback of the content at the vehicle. Examples of play control parameters include play order, play frequency, volume, sound profile, or the like. Play order determines the order in which segments of the content are played, e.g., the song order. Play frequency determines the frequency with which segments of the content are played, e.g., a favorite song is played once an hour, five percent of the time, every ten songs, or the like. Volume determines the volume with which segments of the content are played, e.g., a rock song is played at high volume and an easy listening song is played at low volume. Sound profile determines the tone profile with which segments of the content are played, e.g., a rock song is played with heavy bass and an easy listening song is played with a balanced profile. The play control parameters are determined manually by the user or another person, or can be determined automatically. When playing the content at the vehicle, the content is played back responsive to the play control parameters.

The playlist stored on the server can be revised to suit the changing wishes of the user. The user can change an existing playlist to generate a revised playlist. In one embodiment, the revised playlist is compared to the previous playlist, and new content transmitted to the vehicle by the satellite when the revised playlist is not the same as the previous playlist. The new content can be transmitted automatically when the system detects that the revised playlist is not the same as the previous playlist. In one embodiment, old content can also be removed when the revised playlist is not the same as the previous playlist and some content is no longer desired.

The user can change the playlist stored on the server through various actions, such as the playlist on a computer, actuating buttons on the telematics unit, actuating a remote selector, responding to an email reminder, applying personal preferences, and applying community preferences. The user can change the playlist on a computer attached to a land network in the same manner as the user initially determines the playlist. The user can change the playlist by actuating buttons on the telematics unit, such as pushing a button to add a song currently playing through the live satellite feed to the playlist, then the telematics unit communicates the song information back to the server. The user can change the playlist by actuating a remote selector, such as entering a command on a Bluetooth compatible wireless device or other handheld device, which communicates the remote selection back to the server. The user can change the playlist by responding to an email reminder, such as reminder from the telematics unit by email that the user liked a particular song and prompted the telematics unit to send an email as a reminder. The user can change the playlist by applying personal preferences, which automatically select content for the playlist based on preset user preferences, e.g., selecting new songs by a particular artist or in a particular genre. The user can change the playlist by applying community preferences, which automatically select content for the playlist based on preset group preferences, e.g., selecting new songs in the "Top Ten" popularity list or selected by a user-selected demographic group.

The transactions concerning music delivery can be monitored to regulate or charge for use. In one embodiment, the number of revisions to the playlist is monitored. In one embodiment, the content transmitted to the vehicle by satellite is measured. The numbers can be monitored by number of content segments, such as number of songs, amount of content, such as number of megabytes sent, or the like. In one embodiment, the user is allowed a free predetermined amount of activity in a given time period, such as revisions or megabytes per month, then charged when the free predetermined amount is exceeded in the time period.

While the embodiments of the invention disclosed herein are presently considered to be preferred, various changes and modifications can be made without departing from the scope of the invention. The scope of the invention is indicated in the appended claims, and all changes that come within the meaning and range of equivalents are intended to be embraced therein.

We claim:

1. A method for customized music delivery to a vehicle, the method comprising:

determining a playlist;

storing the playlist on a server;

selecting content corresponding to the playlist;

transmitting the content to the vehicle by satellite;

storing the content in a telematics unit; and measuring revisions to the playlist.

2. The method of claim 1 further comprising:

determining play control parameters for the content;

storing the play control parameters on the server;

transmitting the play control parameters to the vehicle by satellite; and storing the play control parameters in the telematics unit.

3. The method of claim 1 further comprising:

determining associated content information for the content;

storing the associated content information on the server;

transmitting the associated content information to the vehicle by satellite; and storing the associated content information in the telematics unit.

4. The method of claim 1 further comprising revising the playlist stored on the server to generate a revised playlist.

5. A method for customized music delivery to a vehicle, the method comprising:

determining a playlist;

storing the playlist on a server;

selecting content corresponding to the playlist;

transmitting the content to the vehicle by satellite;

storing the content in a telematics unit; and measuring the content transmitted.

6. The method of claim 5 further comprising:

determining play control parameters for the content;

storing the play control parameters on the server;

transmitting the play control parameters to the vehicle by satellite; and storing the play control parameters in the telematics unit.

7. The method of claim 5 further comprising:

determining associated content information for the content;

storing the associated content information on the server;

transmitting the associated content information to the vehicle by satellite; and storing the associated content information in the telematics unit.

8. The method of claim 5 further comprising revising the playlist stored on the server to generate a revised playlist.

9. A system for delivering systemized music to a vehicle, the system comprising:

means for determining a playlist;

means for storing the playlist on a server;

means for selecting content corresponding to the playlist;

means for transmitting the content to a vehicle by satellite;

means for storing the content in a telematics unit; and means for measuring revisions to the playlist.

10. The system of claim 9 further comprising:

means for determining associated content information for the content;

means for storing the associated content information on the server;

means for transmitting the associated content information to the vehicle by satellite; and means for storing the associated content information in the telematics unit.

11. A system for delivering systemized music to a vehicle, the system comprising:

means for determining a playlist;

means for storing the playlist on a server;

means for selecting content corresponding to the playlist;

means for transmitting the content to a vehicle by satellite;

means for storing the content in a telematics unit; and means for measuring the content transmitted.

12. The system of claim 11 further comprising:

means for determining associated content information for the content;

means for storing the associated content information on the server;

means for transmitting the associated content information to the vehicle by satellite; and means for storing the associated content information in the telematics unit.

13. A computer readable medium for delivering customized music to a vehicle, the computer readable medium comprising:

computer readable code for determining a playlist;

computer readable code for storing the playlist on a server;

computer readable code for selecting content corresponding to the playlist;

computer readable code for transmitting the content to the vehicle by satellite;

computer readable code for storing the content in a telematics unit; and computer readable code for measuring revisions to the playlist.

14. A computer readable medium for delivering customized music to a vehicle, the computer readable medium comprising:

computer readable code for determining a playlist;

computer readable code for storing the playlist on a server;

computer readable code for selecting content corresponding to the playlist;

computer readable code for transmitting the content to the vehicle by satellite;

computer readable code for storing the content in a telematics unit; and computer readable code for measuring the content transmitted.

* * * * *